United States Patent [19]

Toth

[11] 4,183,308

[45] Jan. 15, 1980

[54] FLUIDIZED BED UNIT INCLUDING AN ELECTRICAL AIR PREHEAT APPARATUS

[75] Inventor: Dennis A. Toth, Lake Hopatcong, N.J.

[73] Assignee: Foster Wheeler Development Corporation, Livingston, N.J.

[21] Appl. No.: 884,517

[22] Filed: Mar. 8, 1978

[51] Int. Cl.[2] ..... F23D 19/02

[52] U.S. Cl. ..... 110/263; 122/4 D

[58] Field of Search ..... 122/4 D; 110/257, 263; 34/57 A; 165/104 F

[56] References Cited

U.S. PATENT DOCUMENTS

| | | | |
|---|---|---|---|
| 2,010,460 | 8/1935 | McKinley | 110/236 |
| 2,658,742 | 11/1953 | Suter et al. | 122/4 |
| 2,810,739 | 10/1957 | Lake et al. | 122/4 |
| 2,976,853 | 3/1961 | Hunter et al. | 122/4 |
| 3,048,153 | 8/1962 | Abrahamsen | 122/4 |
| 3,119,378 | 1/1964 | Marshall | 122/4 |
| 3,350,915 | 11/1967 | Staffin | 165/104 |
| 3,742,874 | 7/1973 | Eff | 110/212 |
| 3,884,193 | 5/1975 | Bryers | 122/4 |
| 3,911,594 | 10/1975 | McIntire et al. | 34/57 |
| 4,054,376 | 10/1977 | Wareham | 165/104 |

*Primary Examiner*—Kenneth W. Sprague

*Attorney, Agent, or Firm*—Marvin A. Naigur; John E. Wilson; John J. Herguth, Jr.

[57] ABSTRACT

A fluidized bed unit in which a grate is disposed in a housing to divide the housing into an upper chamber and a lower chamber. A bed of particulate material including fuel is supported by the grate and extends in the upper chamber. The lower chamber has an inlet for receiving pressurized air for passing through the lower chamber, the grate, and the bed of particulate material to fluidize the particulate material. An electrical heating unit is provided for preheating the air as it passes through the lower chamber to ignite the fuel material during startup.

2 Claims, 2 Drawing Figures

FLUIDIZED BED UNIT INCLUDING AN ELECTRICAL AIR PREHEAT APPARATUS

BACKGROUND OF THE INVENTION

The present invention relates to a fluidized bed unit and, more particularly, to such a unit including an electrical heater for use during startup.

The use of fluidized beds has been recognized as an attractive means of generating heat. In these arrangements, air is passed through a bed of particulate material, which normally consists of a mixture of inert material and a fossil fuel such as coal, to fluidize the bed and to promote the combustion of the fuel. When the heat produced by the fluidized bed is utilized to convert water to steam, such as in a steam generator, the fluidized bed system offers an attractive combination of high heat release, improved heat transfer to surfaces within the bed, and compact boiler size.

The conventional manner of starting a fluidized bed unit is to employ oil burners, or the like, located in a manner so that they fire above the bed with their flame impinging on the bed surface. However, in this type of arrangement much of the heat is lost to the sidewalls and the fluidizing air which, of course, results in a loss in efficiency and a relatively long bed warm-up time before actual operation can begin.

SUMMARY OF THE INVENTION

It is therefore an object of the present invention to provide a fluidized bed unit in which the startup procedure is achieved in a relative efficient manner with a minimum of heat losses.

It is also an object of the present invention to provide a fluidized bed unit in which the startup procedure is greatly simplified and shortened in time.

It is a further object of the present invention to provide a fluidized bed unit of the above type which employs electrical heating means for preheating the air before it passes through the bed during startup to ignite the fuel material in the bed.

Toward the fulfillment of these and other objects the unit of the present invention comprises a grate disposed in a housing and dividing the housing into an upper chamber and a lower chamber. A bed of particulate material including fuel is supported by the grate and extends in the upper chamber. The lower chamber has an inlet for receiving pressurized air for passing through the lower chamber, the grate and the bed of particulate material to fluidize the particulate material. An electrical heating unit is provided for preheating the air as it passes through the lower chamber.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENTS

Figure 1:
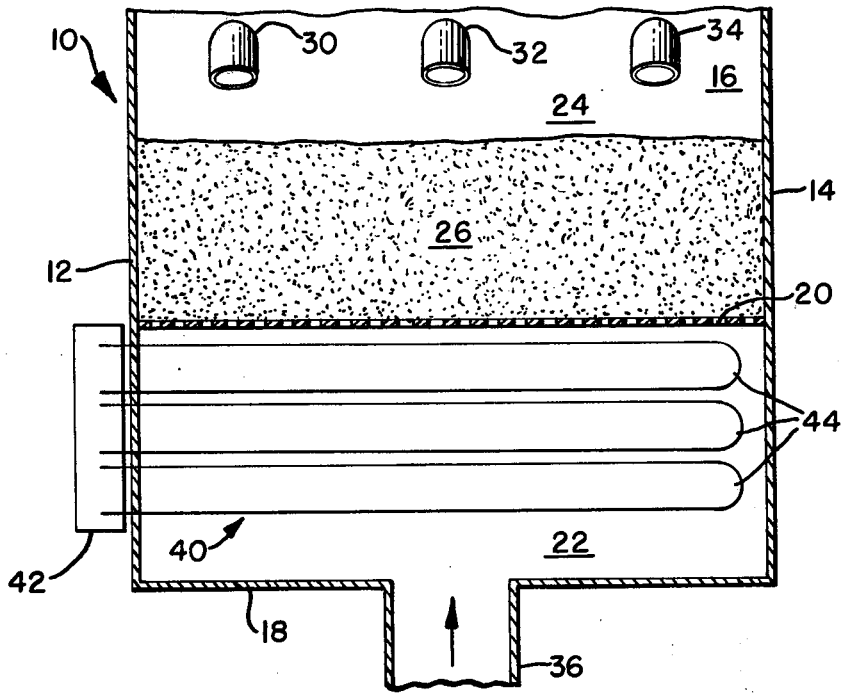
FIG. 1 is a schematic sectional view depicting a portion of a fluidized bed unit employing features of the present invention.

Referring specifically to the embodiment of FIG. 1, the reference numeral 10 refers in general to a fluidized bed unit which can be in the form of a boiler, a reactor, a steam generator, or the like. It is understood that associated equipment such as heat exchange tubes passing through the bed or forming portions of the walls of the vessel, have been omitted from the drawing for the convenience of presentation.

The unit 10 includes a front wall 12, a rear wall 14, a pair of sidewalls, one of which is shown by the reference numeral 16, and a floor 18. The upper portion of the unit is not shown for the convenience of presentation it being understood that it consists of a convection section, a roof and an outlet for allowing the combustion gases to discharge from the boiler in a conventional manner.

A horizontally extending air distribution plate, or grate, 20 extends between the walls 12, 14, and 16 and above the floor 18 to define a lower chamber 22 extending below the grate and an upper chamber 24 extending above the grate.

A bed of particulate material, shown in general by the reference numeral 26, is disposed in the upper chamber 24 and is supported by the grate 20. The bed of particulate material includes a mixture of crushed coal and an inert material such as commercial grade hematite iron ore. Also, a fine limestone or dolomite can be included for use as an adsorbent for the sulfur formed during the combustion of the fuel in a conventional manner.

Three feed pipes 30, 32, and 34 are mounted relative to the sidewall 16 shown in FIG. 1, for introducing the particulate fuel material into the chamber 24 and into the upper portion of the bed 26. It is understood that the feed pipes 30, 32, and 34 can, alternately, be mounted below the upper surface of the bed 26 and be in the form of spreaders, or the like, for providing an in-bed feed of the particulate coal material in a conventional manner.

The floor 18 is provided with an air inlet duct 36 which communicates with the lower portion of the lower chamber 22 and which is connected to a pressurized air source (not shown) for introducing air into the lower chamber. Although not shown in the drawings it is understood that a damper, or the like, may be associated with the air inlet duct 36 to control the flow of air into the chamber 22.

An electrical heating unit, shown in general by the reference numeral 40, is provided in association with the lower chamber 22 and includes a junction box 42 disposed adjacent the front wall 12 and immediately externally thereof and a plurality of heating elements 44 extending from the junction box, through the wall 12 and into the chamber 22. The heating elements are of a substantially "U" shape and extend for substantially the entire width, or depth, of the chamber 22. The junction box provides a coupling for the ends of the heating elements 44 and is adapted for connection to a source of electrical energy for actuating the heating elements in a conventional manner to generate heat in the lower chamber 22.

Although not clear from the drawings it is understood that the heating unit may be disposed towards one side of the fluidized bed unit 10, i.e., immediately adjacent one of the sidewalls 16, but does not extend for the entire length of the unit in a direction perpendicular to the plane of the drawing. In fact, a startup section of the unit may be defined adjacent one sidewall 16 which would include a side portion of the fluidized bed 26 and, of course, the heating elements 44 extending immediately thereunder.

In operation, air is introduced into the inlet duct 36 and passes into and through the chamber 22, the grate 20 and the fluidized bed 26 before exiting out the upper portion of the unit 10. The heating unit 40 is activated to apply heat to the air as it passes through the chamber 22, thereby forcing the heat into the bed material and minimizing heat losses to the walls 12, 14, and 16.

As soon as the particulate fuel material reaches ignition temperature, the heating unit 40 may be deactivated, and the bed will continue to operate in a conventional manner, with additional particulate fuel material being introduced into the bed 26 via the feeder pipes 30, 32, and 34, as needed.

Figure 2:
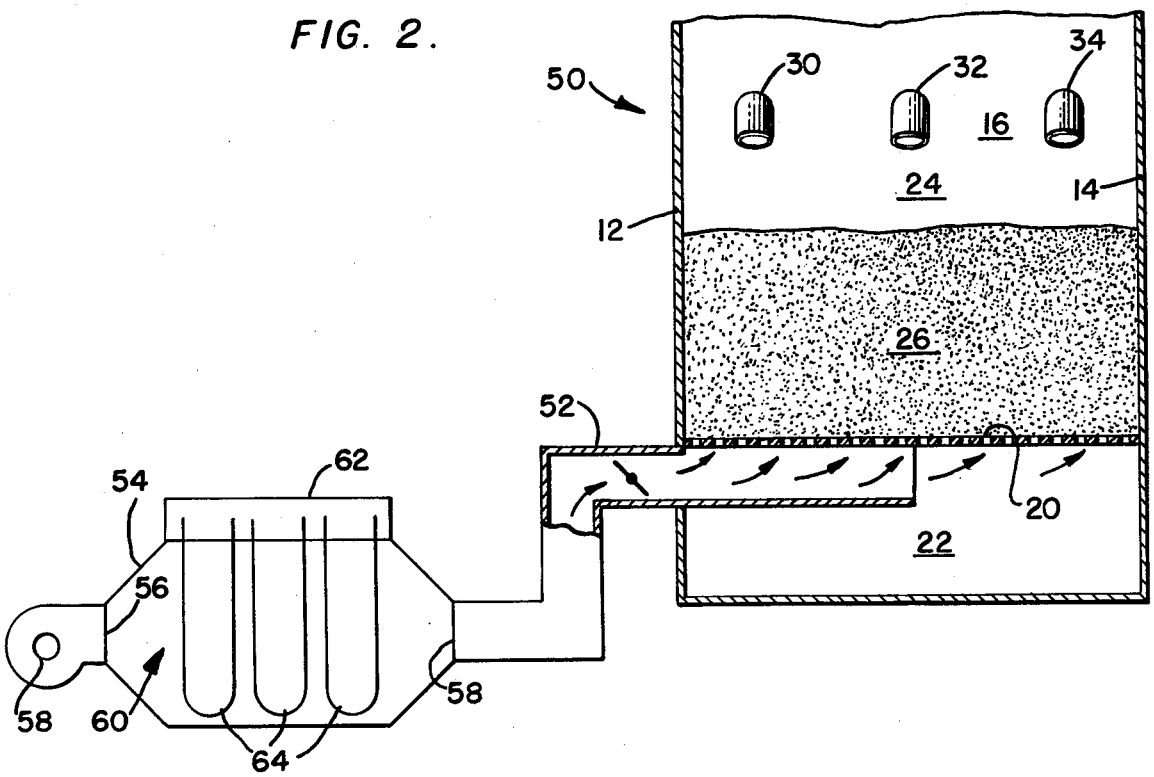
FIG. 2 is a view similar to FIG. 1 but depicting an alternate embodiment of the present invention.

FIG. 2 depicts an alternate embodiment of the present invention. Since this unit is similar in many respects to the unit of the previous embodiment, components that are identical to the components in the previous embodiment are referred to by the same reference numerals and will not be described in any further detail. In particular, the fluidized bed unit of the embodiment of FIG. 2 is referred to in general by the reference numeral 50 and includes an air duct 52 which extends through the front wall 12 and into the lower chamber 22. The duct 52 extends into the chamber 22 for about half the width thereof and has an open end and an open upper wall which permits air to flow into and through the grate 20, the bed 26, and the upper chamber 24 as in the previous embodiment.

An air plenum chamber 54 is provided adjacent the front wall 12 and includes an air inlet 56 which is connected to a fan 58, or the like, and an air outlet 58 connected to the duct 52. An electrical heating unit 60 is supported by the air plenum chamber 54 and includes a junction box 62 mounted adjacent the upper wall of the chamber and a plurality of heating elements 64 extending from the junction box, through the latter wall and into the chamber.

The operation of the embodiment of FIG. 2 is similar to that of FIG. 1 with the exception that ambient air from the fan 58 is preheated in the plenum chamber 54 before passing through the duct 52 and the plate 20, the bed 26 and the upper chamber 24 to ignite the particulate fuel material in the bed during startup.

Both of the above embodiments have several advantages. For example, use of the electrical heating units 40 and 60, respectively, simplifies the startup procedure and reduces the bed warm-up time for the units 10 and 50, respectively. Also, the use of oil burners firing above the bed are eliminated and heat losses to the walls of the unit are minimized. In addition, after startup according to the present invention, the normal combustion process may begin without interruption of the combustion air flow.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is :

1. A fluidized bed unit comprising a housing, grate means disposed in said housing and dividing said housing into an upper chamber and a lower chamber, a bed of particulate material including fuel supported by said grate means and extending in said upper chamber, said lower chamber having an inlet, at least one electrical heating unit disposed in said lower chamber, and duct means connected to said inlet for passing pressurized air into said inlet where it passes through said lower chamber, across said electrical heating unit and through said grate means and said bed of particulate material to fluidize said particulate material, said heating unit preheating the air as it passes through said lower chamber.

2. The unit of claim 1, wherein said electrical heating unit comprises a plurality of heating elements extending through a wall of said housing and into said lower chamber and further comprising a junction box mounted to said wall and connected to said heating elements.

* * * * *